United States Patent [19]

Pretini

[11] 4,122,783

[45] Oct. 31, 1978

[54] APPARATUS FOR PROTECTING A ROOM AGAINST PENETRATION THEREINTO OF ARMED PERSONS

[76] Inventor: Gisberto Pretini, S. Frediano a Settimo, Pisa, Italy

[21] Appl. No.: 762,803

[22] Filed: Jan. 26, 1977

[30] Foreign Application Priority Data

Jan. 30, 1976 [IT] Italy ..... 9329 A/76

[51] Int. Cl.[2] ..... E05G 5/02

[52] U.S. Cl. ..... 109/3; 109/8

[58] Field of Search ..... 109/2, 3, 6, 7, 8; 340/276

[56] References Cited

U.S. PATENT DOCUMENTS

| | | | |
|---|---|---|---|
| 1,392,095 | 9/1921 | Valinski | 109/3 |
| 1,965,030 | 7/1934 | Clark | 109/8 |
| 2,033,694 | 3/1936 | Eldred | 109/3 |
| 2,051,223 | 8/1936 | Olsen | 109/2 X |
| 2,181,648 | 11/1939 | Becker et al. | 109/2 X |
| 3,924,546 | 12/1975 | Pretini | 109/3 |

FOREIGN PATENT DOCUMENTS

| | | | |
|---|---|---|---|
| 2,262,355 | 9/1975 | France | 109/2 |

*Primary Examiner*—Mervin Stein

*Assistant Examiner*—David H. Corbin

*Attorney, Agent, or Firm*—McGlew and Tuttle

[57] ABSTRACT

Access to the room is provided only by a movable compartment which must be entered by a person, at an entry opening, and moved along an access path, to an access opening, in order for the person to enter the room. A magnetic detector is provided either wholly within the compartment, or along the access path, or partly within the compartment and partly along the access path, to detect the presence of ferromagnetic masses, such as weapons, carried by a person within the movable compartment. Known locking device are provided so that, upon such detection of the presence of a ferromagnetic mass, movement of the compartment along the access path to the access opening can be interrupted so that the person is retained in the compartment. The compartment may comprise a box reciprocable along the access path between the entry opening and the access opening, or may be a section of a revolving door and, in either case, the compartment is formed of non-magnetic material. A television camera or the like may be provided either adjacent the entry opening or along the path to obtain a picture of a person entering the compartment.

15 Claims, 11 Drawing Figures

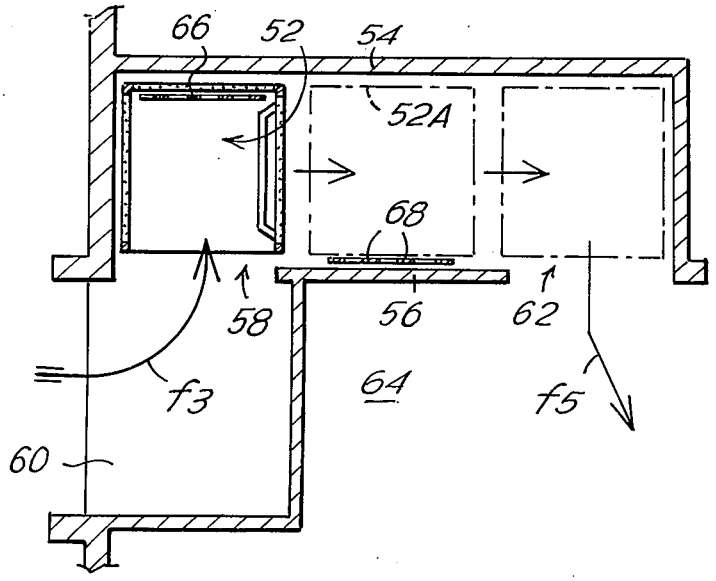
Fig.4
Fig.5
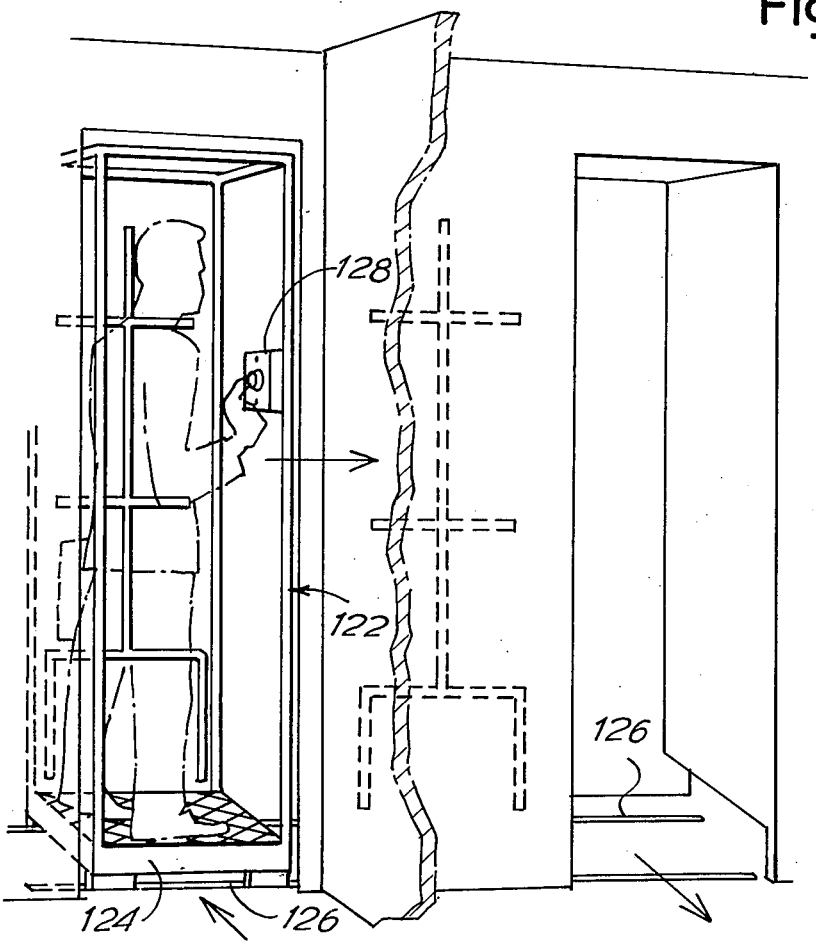

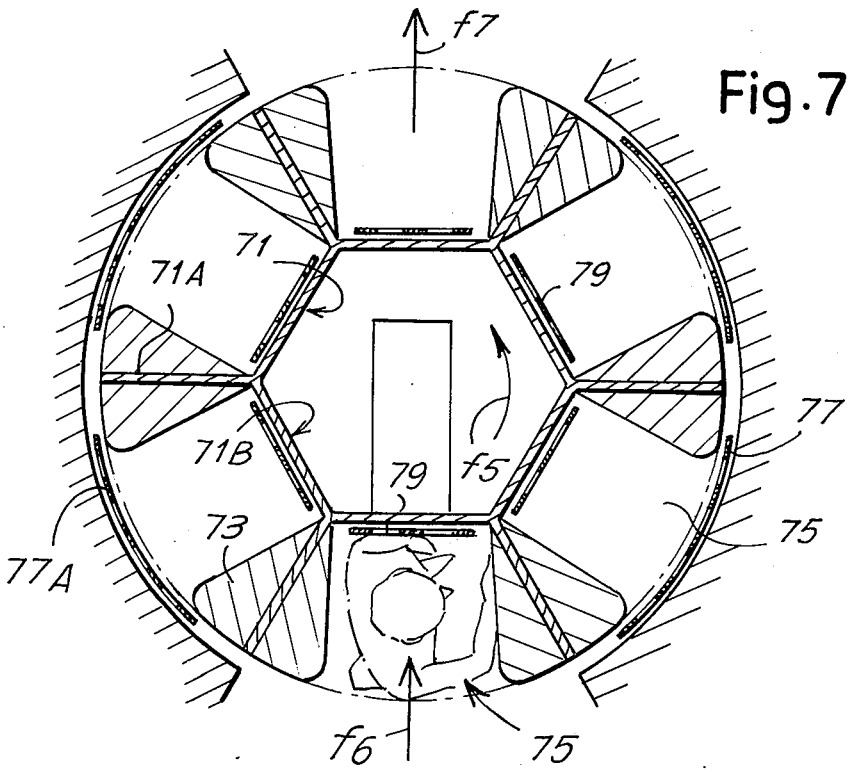
Fig. 7
Fig. 8
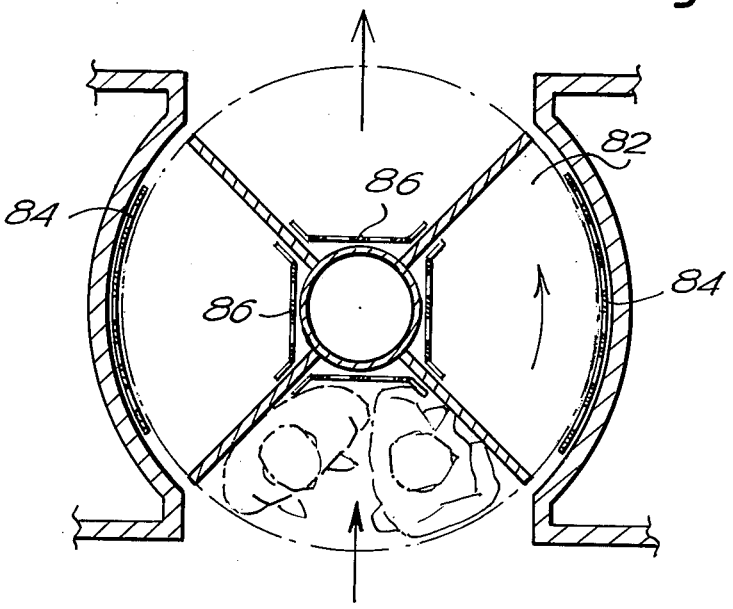

APPARATUS FOR PROTECTING A ROOM AGAINST PENETRATION THEREINTO OF ARMED PERSONS

FIELD AND BACKGROUND OF THE INVENTION

This invention relates to apparatus for protecting a room or other area against penetration thereinto of armed persons, using a detector for detecting the presence of ferromagnetic masses, such as weapons, carried by persons attempting to enter the room or area, and preferably including television recording means and locking means for preventing access to the room or area.

DESCRIPTION OF THE PRIOR ART

Various arrangements have hitherto been proposed for preventing access to a room, such as a banking room, by persons intending to commit a felony, such as a bank holdup. Among these previously proposed devices, there are known devices for locking such a person in a compartment, such as a compartment of a rotary door. As representative of the patented prior art, there may be cited English, U.S. Pat. No. 1,889,853, Clark, U.S. Pat. No. 1,965,030, Pace, U.S. Pat. No. 3,285,209, and Pretini, U.S. Pat. No. 3,924,546, although many other patents have been issued on such devices.

The known devices include various means for detecting the presence of an unwanted intruder, such as television cameras, and the like. However, the known systems rely upon visual observation of a person desiring to enter the room along an access path, and such visual observation is not always the most effective means for detecting an armed robber attempting to obtain access to the protected room, such as a bank floor. In addition, the known arrangements have required a relatively large amount of floor space, which is generally undesirable.

SUMMARY OF THE INVENTION

The objective of the present invention is to protect a room against penetration thereinto of armed persons, requiring only minimum dimensions in the room to be protected.

In accordance with the invention, the detector is arranged to act on an access path to the room and along which there is movable a compartment, such as a box or a section of a revolving door, and which compartment must be entered by a person or persons in order for the person or persons to enter the protected room. Means are provided to neutralize the intended criminal action in the event that the apparatus detects a ferrogmagnetic mass within the movable compartment, in order to prevent egress from the compartment into the protected room. A television camera or the like can be provided to record the images of people planning to enter the protected room, and a locking device may be provided to prevent movement of the compartment along the access path to an access opening providing entry into the room to be protected.

In one embodiment, the compartment may be formed as a rotary door having radial partitions defining the compartments, and which partitions may be specially shaped, with the rotary door having a fixed central axis at which at least some of the detector components are arranged.

In accordance with another embodiment of the invention, the compartment may be formed like a box which is reciprocable in two opposite directions along a closed guide corridor extending between an entry opening, for receiving a person, and an access opening, opening into the protected room, the guide corridor preferably being rectilinear.

An object of the invention is to provide improved apparatus for protecting a room against penetration thereinto of armed persons.

Another object of the invention is to provide such an apparatus comprising a movable compartment which must be entered by a person, at an entry opening, and moved along an access path, to an access opening, in order for such person to enter the protected room.

A further object of the invention is to provide such an apparatus including detector means operatively associated with either the access path or the compartment, or both, and operable to detect the presence of ferromagnetic masses, such as weapons, carried by a person within the movable compartment.

For an understanding of the principles of the invention, reference is made to the following description of typical embodiments thereof as illustrated in the accompanying drawings.

BRIEF DESCRIPTION OF THE DRAWINGS

In the Drawings:

FIG. 4 is a view, similar to FIGS. 1, 2 and 3, illustrating an installation of apparatus embodying the invention, and having minimum dimensions;

FIGS. 5 and 6 are partial perspective views illustrating two different embodiments of a box reciprocable along a rectilinear access path;

FIG. 7 is a horizontal sectional view of an embodiment of the apparatus in which the movable compartment is in the form of a rotary door of the anti-hostage type;

FIG. 8 is a view, similar to FIG. 7, but illustrating a modification wherein more than one person can enter the same compartment of the rotary door;

DESCRIPTION OF THE PREFERRED EMBODIMENTS

Figure 1:
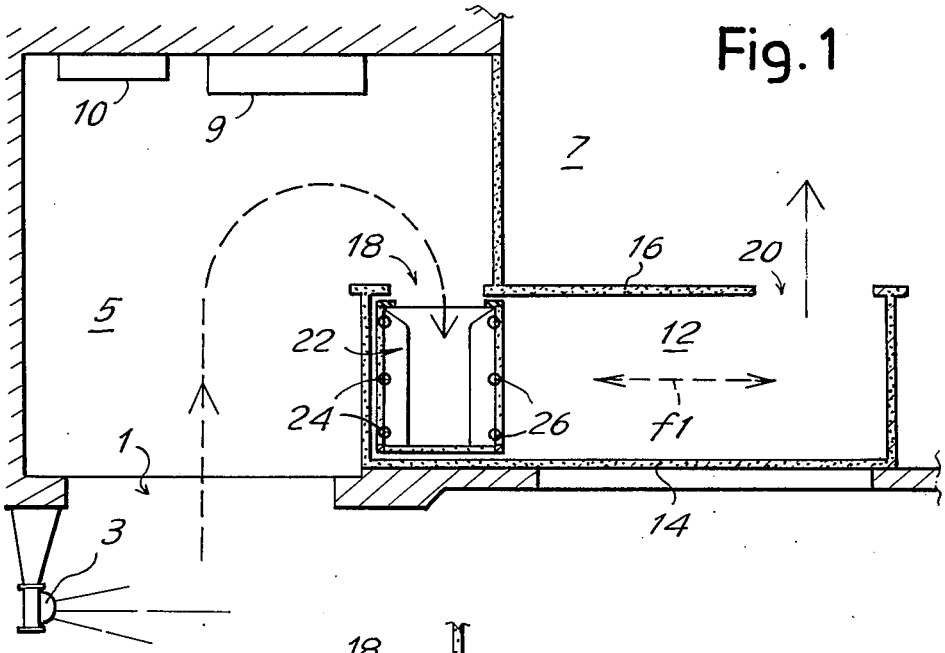
FIGS. 1, 2 and 3 are somewhat schematic horizontal sectional views of apparatus embodying the invention, illustrating three alternative locations of the cooperating components of the ferromagnetic mass detector for producing the magnetic field.
Figure 2:
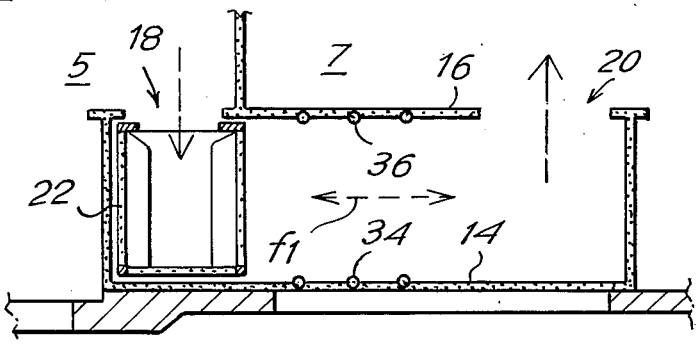
Figure 3:
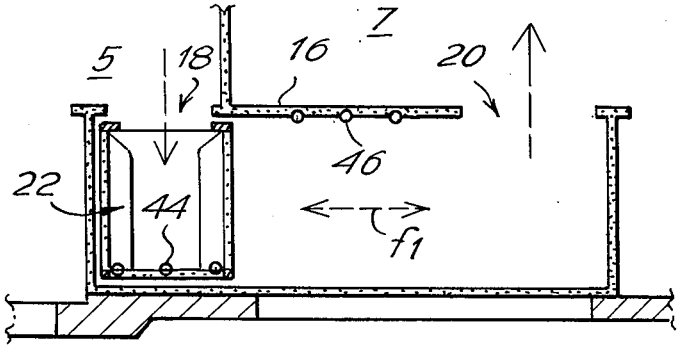

In the embodiments of the invention shown diagrammatically in FIGS. 1, 2 and 3, an access or entrance from the pavement or the like is indicated at 1, and may be provided with optical detection means 3, for example, television recording means for controlling the persons who plan to enter into the protected room, like a bank office, and as shown in prior U.S. patents of the present inventor. A restricted space, with respect to a room 7 controlled, as to access, by the apparatus of the invention, is illustrated at 5, and the apparatus is arranged to control passage from the space 5 into the room 7. In the space 5, there can be provided, for example, a cabinet 9 for depositing the arms, if any, carried by a customer authorized to carry arms, and which arms must be deposited before entering the room 7. The space 5 also has a device 10, in the form of a box or the like for continuous acceptance of covers, for depositing metal coins, which are often of ferromagnetic material and thus may cause monitoring, if there is a large amount thereof.

The apparatus proper includes a corridor 12, preferably rectilinear, which is defined by walls 14 and 16 at least one of which advantageously is constructed of bullet-proof transparent glass or the like. Access to corridor 12 from space 5 is possible through an entry opening 18, while an access opening 20 affords communication between corridor 12 and the room 7 to be protected. The opening 18 is considered as the entry opening and the opening 20 as the access opening on the assumption that the apparatus is arranged only to control access to the room 7.

A box, generally denoted by 22, is arranged in corridor 12 for reciprocation in opposite directions therealong, as indicated by the arrow f1. Box 22 has a space for only a single person, which may be provided by means of space reducers, and the space within box 22 can be aligned with the passages 18 and 20 in the respective end positions to which the box 22 is movable.

In the embodiment of FIG. 1, box 22 has, on the two sides thereof perpendicular to the direction of reciprocation of the box, two series of elements 24 and 26 constituting the antennas or poles for producing the magnetic field in the accessible space of box 22, by forming therein the magnetic field of the detector. Suitable connections are provided between the stationary part of the detector and its movable components 24 and 26.

If anyone enters box 22 carrying a weapon, the weapon constitutes a ferromagnetic mass which is detected by the apparatus when the person enters the box or during transit of the person along the corridor 12 in the event that the detector is arranged in a position intermediate the entry opening 18 and the access opening 20. Detection of a ferromagnetic mass within box 22 causes the box to be locked against movement along corridor 12 through suitable braking means (by interception or in any other suitable manner) at the position where the detection occurs, and this prevents access into room 7 and locks the person in the box if the detection takes place along the access path defined by the corridor 12. Such braking and interception means are known from the prior art, as mentioned.

In the embodiment shown in FIG. 2, elements identical to those of FIG. 1 are indicated by the same reference numerals. In this modification, instead of the components 24 and 26 of the detector being movable in the box 22, corresponding components 34 and 36 are arranged on, or against, walls 14 and 16 defining corridor 12. In this embodiment, detection of the presence of a ferromagnetic mass in box 22 takes place when box 22 reaches the spaced components 34 and 36.

In the modification shown in FIG. 3, again the same reference numerals are used for parts which are similar or identical to those shown in FIGS. 1 and 2. In this embodiment of the invention, box 22 carries some of the detector components 44 movable with the box and adapted to cooperate with other components 46 arranged on a stationary wall, for example on the wall 16. The components 44 and 46 cooperably provide the detector magnetic field when box 22, with its components 44, is aligned or substantially aligned with the stationary components 46.

FIG. 4 illustrates a modification wherein a box 52 is movable along a corridor defined by walls 54 and 56, between an entry 58 combined with the passage 60, leading, for example, from the pavement, and an access opening 62 for entry into the protected room 64. In this embodiment, box 52 is provided with a detector component or components 66 movable therewith and cooperable with a detector component or components 68 supported on the wall 56 and cooperating with component 66 when box 52 is in a position intermediate entry opening 58 and access opening 62. A person may enter box 52, as indicated by arrow f3, and exit from the box, as indicated by arrow f5, if the person does not carry any weapons. On the other hand, if the presence of a ferromagnetic mass, presumably constituted by arms or weapons, is detected, box 52 is locked in the position indicated at 52A.

Figure 6:
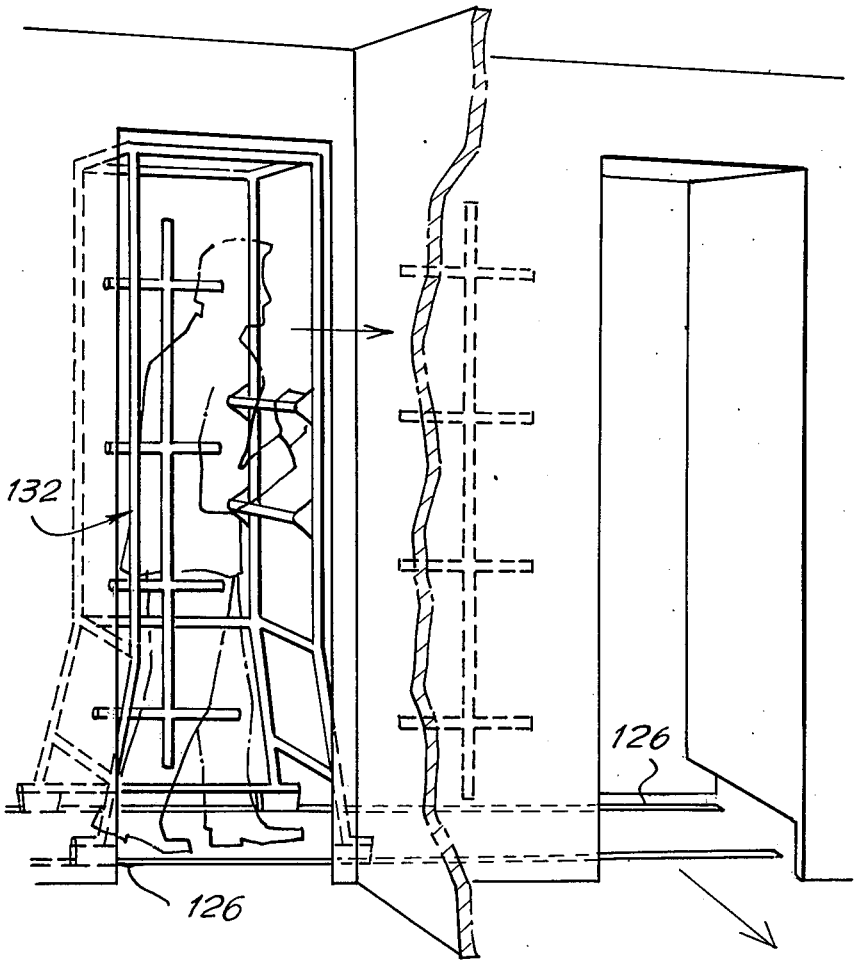

For the embodiments shown in FIGS. 1 through 4, there can be used a box with a floor like a carriage, slidable on ways, such as the box 122 of FIG. 5 having the floor 124 slidable on ways 126. In this case, the user, by pressing a pushbutton 128, energizes a motor for moving box 122 along the access path. On the other hand, and as shown in FIG. 6, there may be used a box 132 which is open at the bottom and is suitably arranged so that the user, walking along the access path, can move in the desired direction for either entering into the bank or exiting therefrom.

FIG. 7 illustrates another embodiment of the invention wherein a rotor 71 is arranged to be angularly displaced, for example in a single direction as shown by the arrow f5, and having radial walls defining compartments 75. Compartments 75 are defined by radial walls 71A, inner walls 71B, and shaped projecting elements 73, and the compartments are adapted to accommodate only one person at a time who thus may move from an entry opening shown by arrow f6 to an access opening or exit indicated by arrow f7. The exit or access opening may be diametrically opposite to the entry opening, or at any angle thereto, with respect to the radial position of the entry opening, for reaching the room to be protected. In this embodiment of the invention, the rotor is of the anti-hostage type, that is, the spaces of the rotor, defined by the radial walls and the projecting elements 73, are appropriately limited by "reducers" so that, in each compartment 75, only one person at a time may be present.

Along the access path defined by movement of a compartment 75, and on a fixed or stationary portion of the building surrounding the rotor, there is provided a series of detector components 77 which cooperate with detector components 79 each arranged in a respective compartment 75, to produce, at a certain position along the access path leading from the entry opening to the access opening, a magnetic field adapted to monitor the presence of a ferromagnetic mass carried by the person transiting in the direction of arrow f5. The stationary components of the detection system may be provided both in the positions 77, as indicated, and also, possibly for other reasons, in the positions indicated at 77A.

In the embodiments of the invention so far described, the movable compartments can receive only one person at a time. This avoids the danger of an armed intruder taking a hostage and, by threatening to harm the hostage, compelling control personnel to function in a manner to allow the armed intruder to escape or, however, any operation which might be otherwise avoided.

The impossibility of two persons at a time standing together in the movable compartment by itself assures an anti-hostage protection. If there is desired a movable compartment or box which, at the same time, offers anti-hostage protection and the possibility of transporting, from the outside into the protected room, suitcases and other heavy parcels, in particular for operations of deposit and withdrawing from a room where safe deposit boxes are installed, there can be provided wider boxes by reducing the room by means of suitable reducers while leaving, at the bottom of the movable compartment or box, a space considered optimum for the required performance, as is seen, for example, in FIG. 6.

When an anti-hostage protection is not required, or when a denser flow of persons is desired, wider boxes can be used, for example, as shown in FIG. 8. Referring to FIG. 8, the rotor arrangement has compartments 82 which may accommodate two or even more persons at the same time. Other than this, the arrangement is similar to that shown in FIG. 7 in that there are provided stationary detector components 84 cooperating with detector components 86 movable with the rotor and each arranged in a respective movable compartment 82, detection being effected when the components 84 and 86 face each other to co-act through the space within the compartment.

Whichever embodiment is adopted, means are provided to lock the movable compartment in the detection position, in order to prevent an armed person, who has caused the monitoring, from reaching the protected space. These locking means may be formed by path intercepting means, braking means, possibly even friction braking means, or any other suitable and easily conceivable system, some of which are shown in the prior art. For example, a friction brake can be provided, or a plug locking system with an electromagnetic or pneumatic control, or an equivalent system. These systems are so arranged as to allow intervention from the outside, in such a manner, however, to release the person who is in the movable compartment. This control does not diminish the dissuasive power of the apparatus, as it cannot be damaged and does not offer any possibility of escape to the last intruder, if the plant is of the anti-hostage type.

The supply sources for the detector of ferromagnetic masses and the supply sources for the power for effecting locking of the movable compartments can be appropriately independent of the conventional electric power sources or the like, such as outside power lines, which could be fraudulently damaged in the course of a criminal action. Thus, provision can be made for a system of electric power storage in the form of batteries, or a pressure power storage system of the pneumatic type or the like.

In the embodiment of the invention shown in FIGS. 9 through 11, 201 indicates the floor on which persons walk to go through the rotary door, and 203 indicates the overlying structure, such as a lintel, for mounting the door. The door can be installed, as shown in these figures, in a corridor, or can be combined with a partition wall of a wider room. In any case, on the stationary structure of floor 201 or on the upper ceiling structure 203 or upper floor structure or the like, or both, stationary lateral walls 205 are provided to extend, as shown in these figures, in the form of flat panels having a substantially polygonal arrangement in plan, and to define dimensions nearly equal to the cylindrical dimensions of a "drum" having two passages for transit which can be diametrically opposite, as shown at 207 in these figures, or which can be arranged at an angular spacing from each other of an extent sufficient for the stated purposes.

In the "drum" space defined by walls 205, there is provided centrally a stationary structure which includes a vertical column, for example an axis 209, mounted on floor 201 and extending upwardly in such a manner as to engage the upper structure 203. Intermediate the height of boxes 201 and along almost the entire available height, there is provided a vertically oriented cylinder 210 of a bullet-proof material and having a diameter appropriate for the purposes hereinafter stated. Cylinder 210 is formed with a longitudinal seat or recess 210A arranged in such a manner as to allow the housing of one of the components 212 of a weapon or ferromagnetic mass detector to detect a weapon or other ferromagnetic material carried by a transiting person. The other component 214 of the detector is located in a position opposed to and radially aligned with the component 212, component 214 being arranged in the stationary wall 205. Thus, the space between the two components 212 and 214 can be controlled in such a manner as to detect the transit, through the space, of a ferromagnetic body having a mass greater than a predetermined amount.

On stationary axis 209, below and above cylinder 210, there are arranged bearings 216 and 218, respectively, which serve to support the rotating unit surrounding the fixed axis 209 as well as to support the stationary cylinder 210. These bearings, which are radial and thrust bearings, have their outer housings or outer rings fixed to respective radial arms 222 and 220 for frames 224 which define a framing on at least three sides for inserting thereinto movable radial panels 226 which extend substantially across the space between stationary cylinder 210 and stationary walls 205, to form walls defining unitary spaces or movable compartments for the passage of persons. The movable compartments are further defined by the cylindrical wall of cylinder 210 and by the outer fixed walls 205.

In order to arrange the individual spaces so as to accommodate a single person while giving the person a certain comfort and capability of movement, in particular to allow the person to walk, space reducers 228 can be applied to panels 226 in order to limit the individual space, between successive panels, through a distance equal to the intermediate height of a person, these reducers possibly being tapered. In this way, it is possible to accommodate, in an individual space, only one person while offering enough space, above the reducers 228 for the person's head and arms, and below the spaces 228, for easy walking ahead on floor 201.

Frames 220, 222 and 224 can rest slidably on floor 201, for example, by means of rollers allowing the assembly to rotate around the fixed axis 209 for movement of panels 226 in such a manner as to allow persons to freely pass from one opening 207 to the other. The rollers can at least partially support the weight of the rotary drum, lightening the bearings 216, 218 or possibly permitting omission of the lower bearing 216.

Arms for supporting cylinder 210 from stationary axis or column 209 are diagrammatically illustrated at 229.

The detection apparatus can be accommodated within the interior of fixed cylinder 210, and access may be provided through a door 231 hinged to the cylinder 210 at 232.

The rotor is provided with suitable automatic means, semi-automatic means, or remote manual control means to effect locking thereof against movement at any moment, thereby locking within the movable compartment any person present therein in an individual space between two adjacent panels, drum 210 and fixed outer wall 205, such locking means being known from the prior art, as mentioned above. In particular, the apparatus includes automatic provisions for effecting locking of a person carrying weapons, comprising ferromagnetic masses, detected by the detector 212, 214. In addition to the automatic system, a manual control system also can be provided, or another automatic system can be provided depending on other detection or control means based on other systems. The rotor can also be motorized to assure an average continuity of incoming and exiting customers relative to the bank.

The panels forming the walls 205, the radial panels 226, or both advantageously are made of bullet-proof glass, to make it possible to continuously control what is happening in the space defined by the fixed walls 205, as well as the positive protection of people in the bank, in the event an armed robber remains locked in one of the rotor compartments in alignment with a panel 205.

It is thus possible to provide an assembly which allows an easy installation of the detector, such as the detector 212, 214, and which may be single or arranged for transit in two directions, for example, by providing, on drum 210, two elements 212, for example diametrically opposite each other and, on the fixed walls 205, corresponding components 214, the pairs of elements operating for transit on either side of the fixed drum and rotation being possible in only one direction, or possible even in opposite directions.

In the fixed structure 210, or also in the fixed outer structure, there may be installed a television camera which controls and records the images when a space between adjacent panels 226 passes in front thereof. A similar arrangement can be provided in the apparatus utilizing a rectilinearly reciprocable box.

With the above described embodiment, many advantages are obtained and, in particular, there is obtained a substantially improved practicability with respect to the revolving doors, formed by radial panels fixed to a central movable axis and rotating with the axis. It is possible to effect a regular installation of the metal detector, for detecting an armed person, without trouble or difficulty which may jeopardize the positive operation of the detector. It is also possible to construct the device using non-ferrous metals, thereby assuring the regularity of the detector operation. Above all, the embodiment is substantially less expensive than that obtainable with devices hitherto provided for the same purposes, such as ordinary revolving doors.

Figure 9:
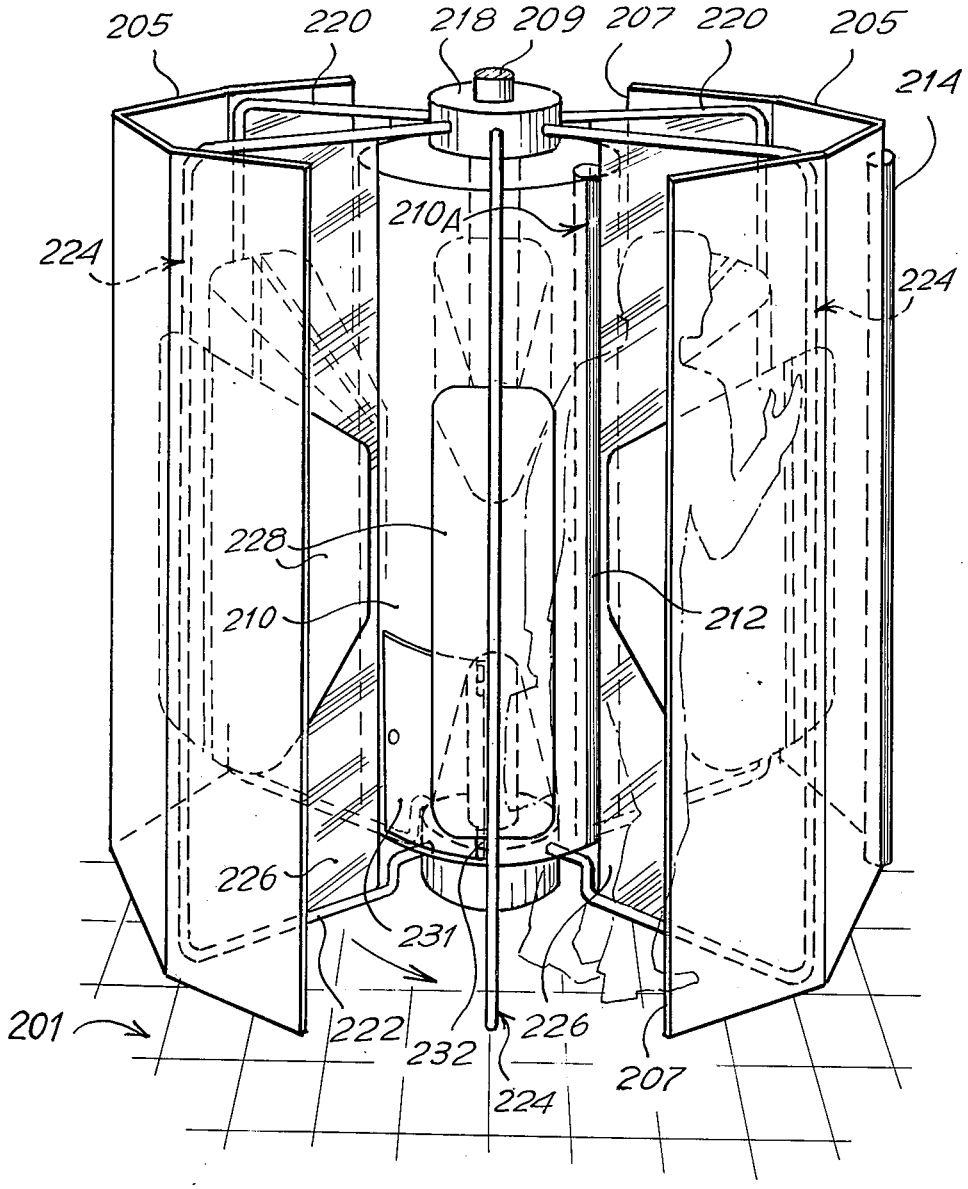
FIG. 9 is a perspective view of an annular drum door structure rotatable about a fixed central cylinder.
Figure 10:
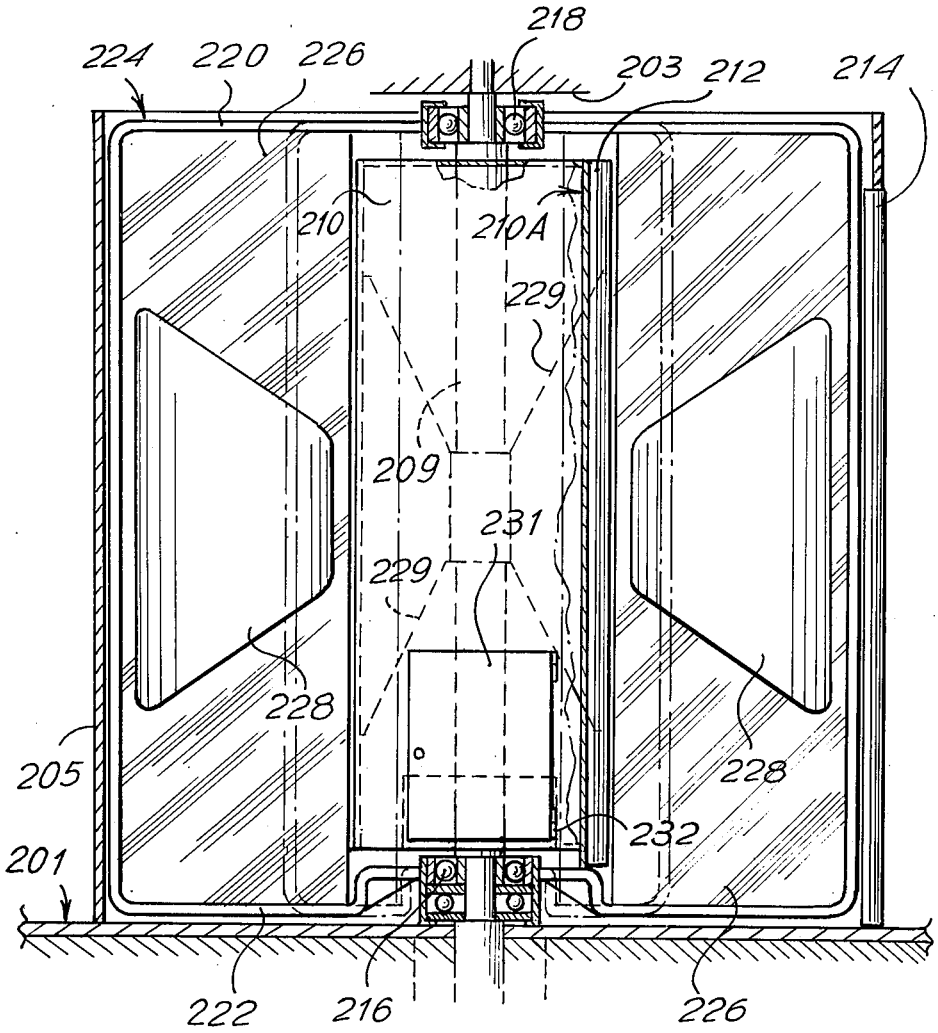
FIG. 10 is a partial vertical sectional view of the structure shown in FIG. 9.
Figure 11:
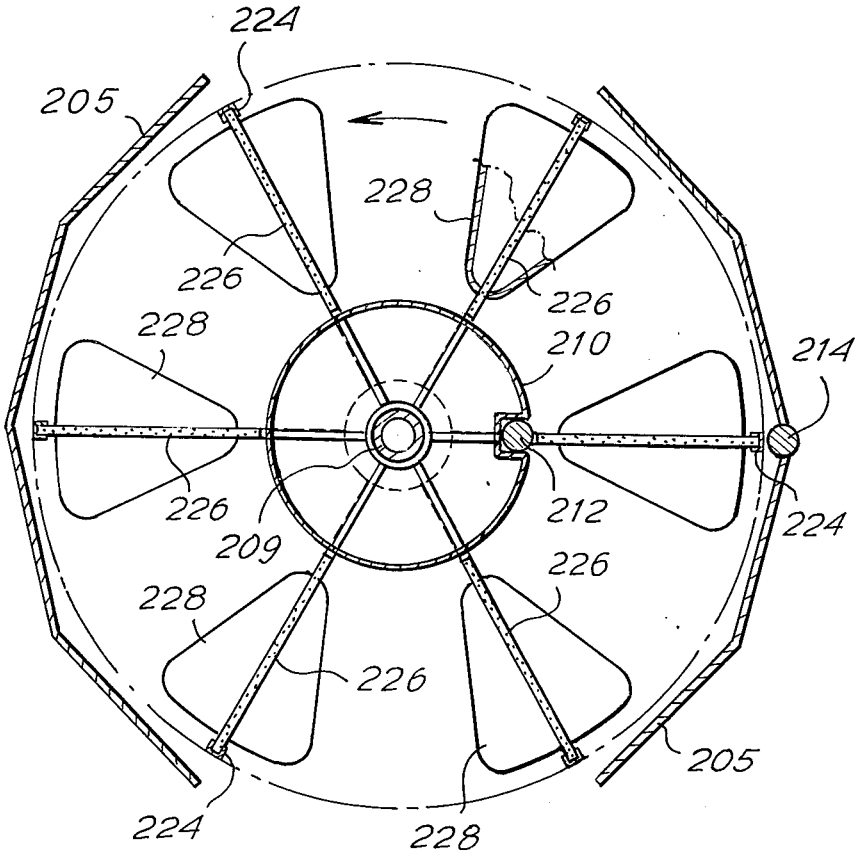
FIG. 11 is a horizontal sectional view of the structure shown in FIG. 9.

In the embodiment of the invention shown in FIGS. 9, 10 and 11, the rotor defines a door having rotary compartments. This door, in contrast to a regular revolving door in which the panels forming the compartment are fixed to a door central axis and rotate integral with this axis or shaft, has a fixed or stationary central axis and the compartments rotate around the fixed or stationary central axis while being supported by two cross-beams. In the particular field of anti-robbery protection, the arrangement shown in FIGS. 9, 10 and 11 provides the possibility of obtaining, from this kind of door, additional specific performances not obtainable with a conventional revolving door. In particular, it is possible therewith to install, on the central fixed axis or shaft, a television camera designed to record, on a magnetic tape, the image of people transiting along the entry corridor to arrive to the door and then to pass into the protected room. This particular specific performance provides a remarkable dissuasive power, right from the moment of planning it, from attempting the robbery, because it forces intentional robbers to enter the bank masked, thus rendering obvious their intentions and making it possible to stop them before they enter the rotary door. It is to be noted that, even if the robbers took a hostage and menaced to kill him, they could never have the certainty of passing into the protected room as, in each compartment of the door, only a single person can be received at a time, so that one of the robbers would, in any case, remain locked on entering the protected space or on leaving the protected space, which involves, for the accomplices, the certainty of being detected, even later, because it is obvious that the locked robber, sooner or later, would talk.

While specific embodiments of the invention have been shown and described in detail to illustrate the application of the principles of the invention, it will be understood that the invention may be embodied otherwise without departing from such principles.

What is claimed is:

1. In apparatus for protecting a room against penetration thereinto of armed persons, of the type including a locking system for access door means for the room, the improvement comprising, in combination, a movable compartment constituting said access door means and which must be entered by a person at an entry opening and moved along an access path to an access opening in order for such person to enter said room, said compartment having walls defining an enclosure open toward said entry and access openings; at least one fixed side wall extending along said access path between said entry opening and said access opening and cooperable with said compartment walls to prevent entry into and exit from said enclosure of said movable compartment except at said entry and access openings; and respective magnetic field producing components on a pair of spaced apart walls included in said walls of said access path and of said compartment, and between which a person must pass to proceed from said entry opening to said access opening; said magnetic field components producing a magnetic field therebetween constituting detector means operable to detect the presence of ferromagnetic masses, such as weapons, carried by a person within said movable compartment as said compartment moves along said access path; said movable compartment, upon such detection of the presence of a ferromagnetic mass thereinto, being arrested at a position along said access path preventing a person, in said movable compartment, entering said room.

2. In apparatus for protecting a room against penetration, the improvement claimed in claim 1, including a recording television camera positioned to record pictures of persons moving along said access path.

3. In apparatus for protecting a room against penetration, the improvement claimed in claim 1, in which said access path is constituted by a rectilinear guide corridor extending between said entry opening and said access opening; said movable compartment comprising a box rectilinearly reciprocable in opposite directions along said guide corridor between said entry opening and said access opening; said detector means being activated during movement of a person to said access opening.

4. In apparatus for protecting a room against penetration, the improvement claimed in claim 3, in which said box is open at the bottom so that it may be pushed along said guide corridor by a person within said box walking along said guide corridor toward said access opening; and means for returning said box to said entry opening.

5. In apparatus for protecting a room against penetration, the improvement claimed in claim 3, in which said box has a movable bottom for supporting a person therein; and means operable to move said box in opposite directions along said guide corridor between said entry opening and said access opening and vice versa.

6. In apparatus for protecting a room against penetration, the improvement claimed in claim 1, in which said detector means comprises two spaced portions; one portion being movable with said compartment and another portion being on a fixed side wall in front of which said compartment transits during its movement from said entry opening to said access opening.

7. In apparatus for protecting a room against penetration, the improvement claimed in claim 1, in which said detector means comprises two portions; both of said portions being mounted in said movable compartment for movement therewith.

8. In apparatus for protecting a room against penetration, the improvement claimed in claim 1, in which said detector means comprises two spaced portions; said two spaced portions being installed in facing relation on fixed side walls on opposite sides of said access path.

9. In apparatus for protecting a room against penetration thereinto of armed persons, of the type including a locking system for access door means for the room, the improvement comprising, in combination, a movable compartment constituting said access door means and which must be entered by a person at an entry opening and moved along an access path to an access opening in order for such person to enter said room; detector means operatively associated with at least one of said access path and said compartment and operable to detect the presence of ferromagnetic masses, such as weapons, carried by a person within said movable compartment; said movable compartment, upon such detection of the presence of a ferromagnetic mass therein, being arrested at a position along said access path preventing a person, in said movable compartment, entering said room; said movable compartment being formed in a rotor-door having radial walls defining respective movable compartments; said access path being defined, in part, by outer walls at least partially enclosing said rotor-door; said rotor-door comprising a central fixed axis; a cylinder concentric with said central fixed axis, fixed against movement, and supported by said central fixed axis; a non-ferromagnetic movable structure rotatable around said central fixed axis and including a series of angularly spaced radially extending rectangular panels, said panels extending outwardly from the external periphery of said cylinder and being movable relative to said cylinder; supporting means for said movable structure including bearings on said central fixed axis; two angularly adjacent radial panels constituting, together with said cylinder, each individual movable compartment designed to accommodate only a single person; a peripheral wall surrounding said rotor-door and having two transit openings spaced angularly from each other by at least the angular extent of an individual movable compartment, one of said transit openings constituting said entry opening and the other of said transit openings constituting said access opening; said detector means comprising two components, one arranged on the inner surface of said peripheral wall and the other arranged on the outer periphery of said cylinder, in radial alignment with each other.

10. In apparatus for protecting a room against penetration, the improvement claimed in claim 9, in which said movable structure is formed with substantially rectangular frames receiving panels of bullet-proof glass; respective arms connecting said frames to at least a bearing at the top portion of said central fixed axis; and rollers supporting said movable structure at its bottom end.

11. In apparatus for protecting a room against penetration, the improvement claimed in claim 9, in which said movable structure is formed with substantially rectangular frames receiving panels of bullet-proof glass; respective arms connecting said frames to at least a bearing at the top portion of said central fixed axis; and respective additional arms connecting said frames to an additional bearing carried by said central fixed axis.

12. In apparatus for protecting a room against penetration, the improvement claimed in claim 9, in which said peripheral wall is polygonal in plan and is formed of bullet-proof glass sheets.

13. In apparatus for protecting a room against penetration, the improvement claimed in claim 9, including a recording television camera mounted on said central fixed axis to control each individual compartment when the latter reaches a preselected position along said axis path.

14. In apparatus for protecting a room against penetration, the improvement claimed in claim 9, in which said detector means comprises two spaced portions; said two spaced portions being installed in facing relation on opposite sides of said access path.

15. In apparatus for protecting a room against penetration, the improvement claimed in claim 9, in which said radial walls are shaped to reduce the space in said movable compartments so that only one person can enter each compartment, for the purpose of providing a specific anti-hostage function for said rotor-door.

* * * * *